United States Patent [19]

Holopainen

[11] Patent Number: 4,590,887

[45] Date of Patent: May 27, 1986

[54] ANIMAL CRADLE

[76] Inventor: Weikko R. Holopainen, Clover Ridge Farm, Barre Rd., Hubbardston, Mass. 01542

[21] Appl. No.: 678,265

[22] Filed: Dec. 5, 1984

[51] Int. Cl.[4] ..... A61D 3/00

[52] U.S. Cl. ..... 119/103

[58] Field of Search ..... 119/103, 99

[56] References Cited

U.S. PATENT DOCUMENTS

| | | | |
|---|---|---|---|
| 2,520,585 | 8/1950 | Walker | 119/103 |
| 2,581,735 | 1/1952 | Turner | 119/103 |
| 2,688,949 | 9/1954 | Butts | 119/103 |
| 3,244,151 | 4/1966 | Gebhart | 119/103 |
| 3,590,784 | 7/1971 | Fly | 119/103 |
| 3,752,126 | 8/1973 | Rhoades | 119/103 |
| 4,195,595 | 4/1980 | Shimonovich | 119/103 |
| 4,350,121 | 9/1982 | Lemin | 119/103 |

*Primary Examiner*—Hugh R. Chamblee
*Attorney, Agent, or Firm*—Blodgett & Blodgett

[57] ABSTRACT

An animal cradle comprising a frame which is adapted to be attached to the bucket of a tractor so that the cradle can be lifted and rotated about a horizontal axis with the bucket when the bucket is raised and rotated by the tractor. The frame has a back wall and an entrance opening at one end. A gate is pivotally mounted to the frame at the opposite end of the frame by extending along the front of the frame and across the entrance opening. Means are provided for supporting the animal within the cradle to enable the cradle to be rotated 90° about a horizontal axis so that the back wall assumes a lower horizontal position wherein the weight of the animal is transferred from the supporting means to the back wall.

11 Claims, 6 Drawing Figures

ANIMAL CRADLE

BACKGROUND OF THE INVENTION

The present invention is generally directed to a restraining cradle for farm animals and is particularly directed to a cradle for supporting a farm animal in an upright position and in a recumbent or reclining position on its side for treatment.

In animal husbandry, it is very often necessary to restrain or immobilize a farm animal for a variety of purposes such as branding, toe nail clipping, or treatment by a veterinarian. Many types of animal restraining devices have been developed for these purposes. One type of device includes a table to which the animal is clamped and means for rotating the table so that the animal is in a reclining position. Another type of device consists of a cradle which includes a frame and supporting table. The cradle is adapted to be rotated so that the animal assumes a reclining position for branding or for other appropriate treatment. Another type of cradle is rotatable so the animal assumes an upright and sitting position.

There are several considerations when restraining farm animals for treatment. To begin with, animals are reluctant to enter into an unfamiliar contraption and it is sometimes difficult to properly position the animal within a restraining device. With some devices, the animal must first be positioned on its side and then rolled over on its belly before it is finally secured in the device. For other devices, the animal is driven through a shoot which leads into the device. When an animal is rotated from a standing to a reclining position, the body of the animal must be supported during the transition. This is generally quite uncomfortable for large animals such as cows and horses, particularly cows where great care must be exercised to avoid applying pressure to the utter. Even if supporting pressure is applied uniformly across the animal's stomach, it is not the best place to support an animal. Another consideration, is the restraining of the animal's head when it is in the device and supporting of the animal's head when it is in the reclining position. By restraining the animal's head, it is prevented from thrashing its head around and causing injury. Also, it is very difficult for an animal to hold its head without support when it is in the reclining position. The prior art restraining devices which are effective to rotate an animal from a standing to a reclining or sitting position, require specialized lifting and rotating machinery which cannot be used for any other purpose. These and other difficulties experienced with the prior art devices have been obviated by the present invention.

It is, therefore, a principle object of the present invention to provide an animal cradle which is adapted to support an animal in the standing and reclining positions and adapted to be attached to the bucket of a tractor so as to be lifted and rotated with the bucket between a first position in which the animal is upright to a second position in which the animal is reclining.

Another object of this invention is the provision of an animal cradle which greatly facilitates the entrance of the animal into the cradle and the proper positioning of the animal within the cradle.

A further object of the present invention is the provision of an animal cradle in which the animal is properly positioned within the cradle and properly secured while the animal is in the standing position.

It is another object of the instant invention to provide an animal cradle in which the animal is supported on its feed in the standing position and on its side in the reclining position and the provision of means for gradually shifting the animal's weight from the animal's feet to its side during the transition from the standing to the reclining position.

A still further object of the invention is the provision of an animal cradle which provides easy and convenient access to the animal for treatment when it is in the reclining position.

It is a further object of the invention to provide an animal cradle in which the animals head is restrained while it is in the cradle and supported when the animal is in the reclining position.

It is a further object of the invention to provide an animal cradle which is simple in construction, which is easy to use, and is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of an animal cradle having a frame which is adapted to be attached to the bucket of a tractor which has a back wall and an opening at one end that is sufficiently large to allow an animal to walk through the opening and into the cradle. A gate is pivotally mounted to the frame at the opposite end of the frame. The gate is swingable from an open position in which it is clear of the opening to a closed position in which the gate extends along the front of the frame and across the opening. Means are provided for supporting the animal to enable the cradle to be rotated 90° about a horizontal axis so that the back wall assumes a lower horizontal position, whereby the weight of the animal is transferred to the back wall. More specifically, the supporting means is a supporting floor for supporting the weight of the animal when it is in the standing position and a broad strap which is adapted to be looped about the animals midsection for supporting the animal during the transition from the standing position to the reclining position.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
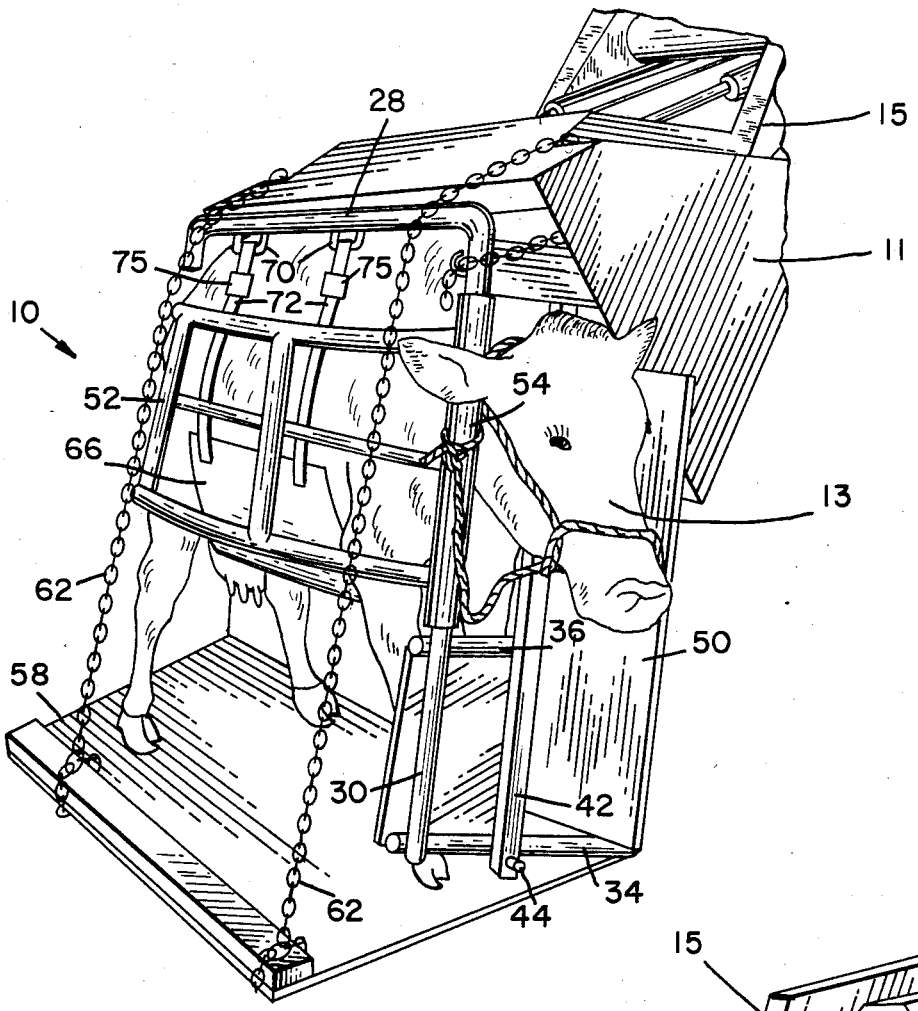
FIG. 1 is a perspective view of the animal cradle shown attached to the bucket of a tractor and containing a farm animal in the upright or standing position.
Figure 2:
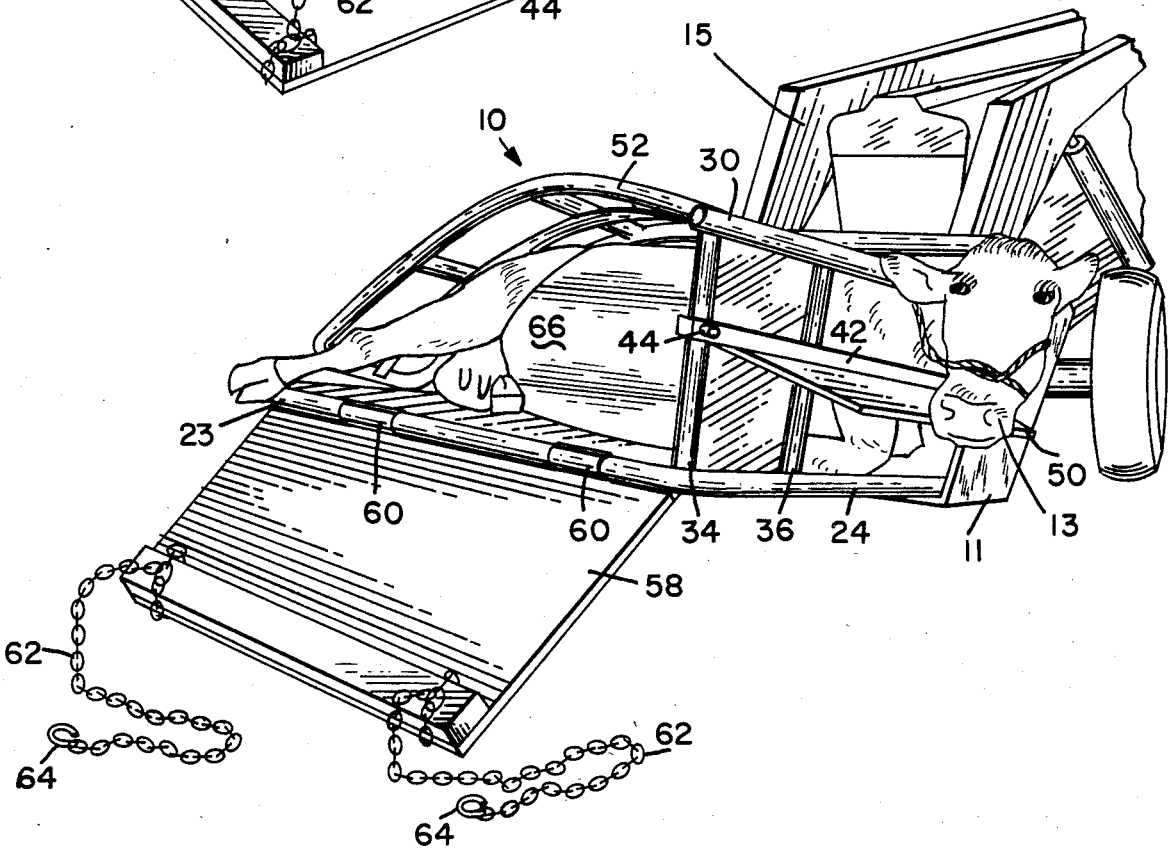
FIG. 2 is a perspective view of the cradle rotated 90° about a horizontal axis for supporting an animal in a recumbent or reclining position.

Referring first to FIGS. 1 and 2, which best show the general features of the invention, the cradle, indicated generally by the reference numeral 10 is shown attached to the bucket 11 of a farm tractor 15, partially shown. The cradle 10 contains a cow 13 shown in the standing or upright position in FIG. 1 and in a reclining position in FIG. 2.

Referring also to FIGS. 3-6, the cradle 10 comprises a tubular framework, generally indicated by the reference numeral 12 and a back wall, generally indicated by the reference numeral 14. The front and left hand side of the cradle is open to define an entrance opening, generally indicated by the reference numeral 16. The back wall 14 is located within a generally rectangular back frame portion, generally indicated by the reference numeral 19. The back wall 14 consists of a heavy wire screen 18 on the outside and a cushioned pad 20 on the inside. The back frame portion 19 consists of a top post 22, a bottom post 23, a right vertical side post 24, and a left vertical side post 25. The front of the framework 12 includes a top front post 28 and a right vertical side post 30. The front and back portions of the frame are connected by a pair of upper connecting bars 32, a lower connecting bar 34, an intermediate connecting bar 36, and an upper brace 38. The posts 24 and 30, the intermediate connecting bar 36, and the brace 38 define a restricted opening, generally indicated by the reference numeral 40 at the right hand side of the cradle. Opening 40 is sufficiently large to receive the head of a farm animal, such as the cow 13 when it enters the cradle. An elongated restraining bar 42 is pivotally connected to the lower connecting bar 34 by means of a pivot pin 44. The restraining bar 42 extends upwardly from the bar 34 across the opening 40 to a point inside of and above the brace 18. A chain 46 is connected to the top of the restraining bar 42 and adapted to be attached to a hook 48 which is fixed to the vertical side post 30. Bar 42 is shown in the open position in FIG. 6, which allows an animal to stick its head through the opening 40 so that it extends outside of the cradle. The effective size of the restricted opening 40 is reduced by moving the restraining bar 42 toward the post 30 against the animals neck and attaching the chain 46 to the hook 48. The flat plate 50 is attached to the restraining bar 42 so that it extends beyond the cradle 10, as shown more clearly in FIGS. 3 and 4. The plate 50 is adapted for supporting the animal's head when the cradle is tilted 90° so that the animal assumes a reclining position on its side, as shown in FIG. 2.

Figure 4:
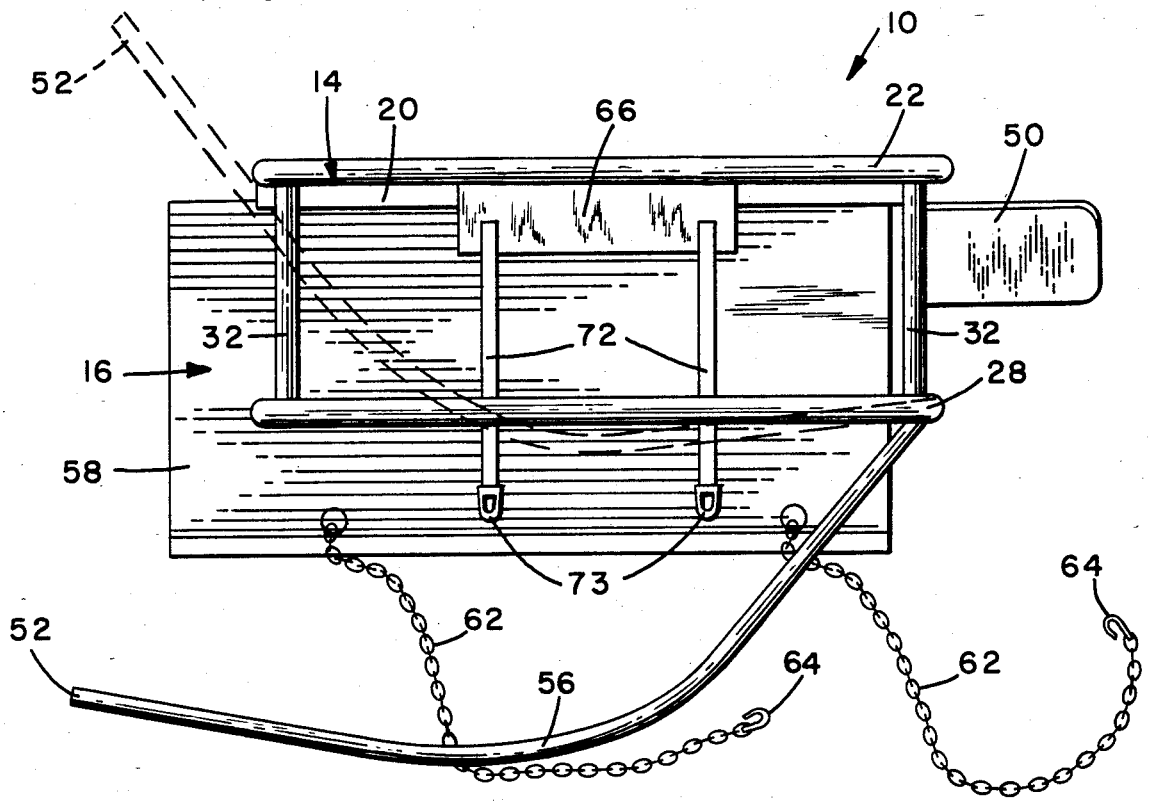
FIG. 4 is a top plan view of the cradle.

A gate 52 is pivotally connected to the vertical side posts 30 by means of a tubular hinge or sleeve 54 rotatably mounted on the post 30 for swinging about the vertical axis of the post 30 from the open, full line, position to the closed, dotted line, position as shown in FIG. 4. The central portion of the gate 50 is bowed outwardly at 56 as shown in FIG. 4 so that the inner side of the gate is concave at the bowed section 56. When the gate 52 is in the open position, as shown in full lines in FIG. 4, the opening 16 is sufficiently large to allow an animal, such as a cow 13, to enter the cradle 10. When the gate 52 is swung to the closed or dotted line position as shown in FIG. 4 the gate is effective to form a barrier along the front and left hand sides of the cradle and thereby enclose an animal which has entered the cradle, as shown in FIG. 1. The gate 52 is made of tubular stock so that it can be easily attached to the left side post 25 by a chain or other appropriate connecting means when the gate is in the closed position.

Figure 5:
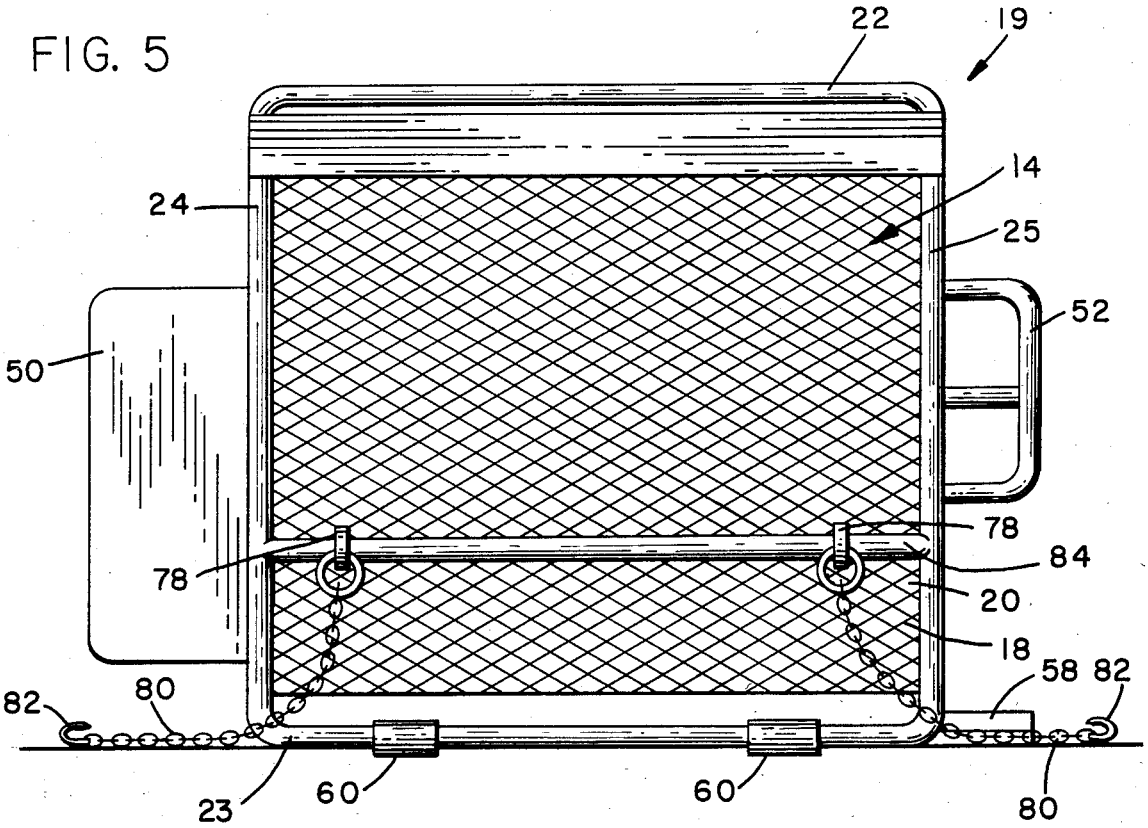
FIG. 5 is a rear elevational view of the cradle.

The cradle 10 also comprises a supporting floor 58 which is pivotally connected to the bottom post 23 of the back frame portion 19 by means of tubular hinges or sleeves 60 which are rotatably mounted on the post 23, see FIG. 5. The front of the floor 58 is supported by means of a pair of chains 62 which are adapted to be connected to the top front post 28 by means of hooks 64. The chains 62 are attached to the front of the floor 58 and looped around the top post 28. The floor 58 is capable of supporting the full weight of a farm animal within the cradle 10 when the cradle is lifted by the bucket of the tractor, as shown in FIG. 1.

Figure 3:
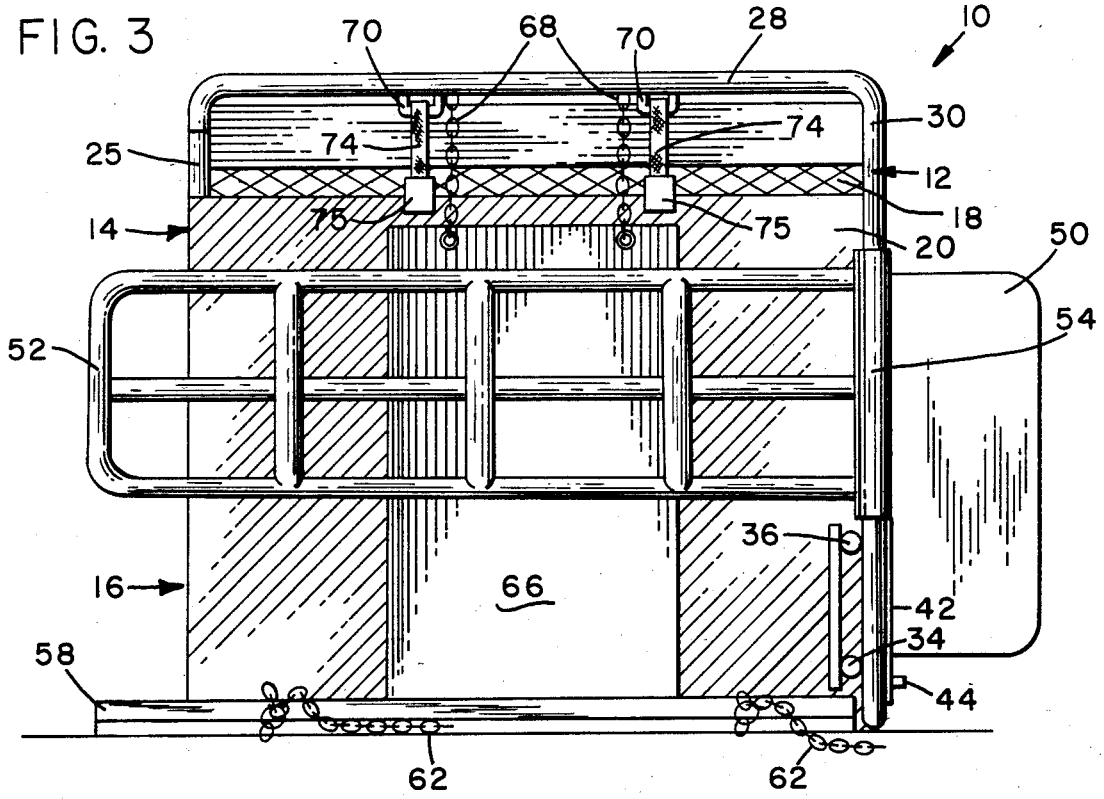
FIG. 3 is a front elevational view of the cradle.

Referring particularly to FIGS. 3 and 4, a broad flexible strap 66 is suspended from the top post 22 by means of a pair of chains 68 which are attached to the post 22 by means of bails 70. Strap 66 is adapted to extend along the front of the cushioned pad 20, as shown in FIG. 3 and down to the floor 58 as shown in FIG. 4. A pair of narrow straps 72 are attached to the lower end of the broad strap 66 as shown in FIG. 4. A pair of narrow straps 74 are fixed to the top front post 28 as shown in FIG. 3. A plunger 73 is attached to the end of each strap 72 and is adapted to engage a buckle 75 which is fixed to the end of each strap 74. The straps 72 and 74 including their respective connecting elements 73 and 75, are, preferably, of the construction used for adjustable seat belts in automobiles.

Figure 6:
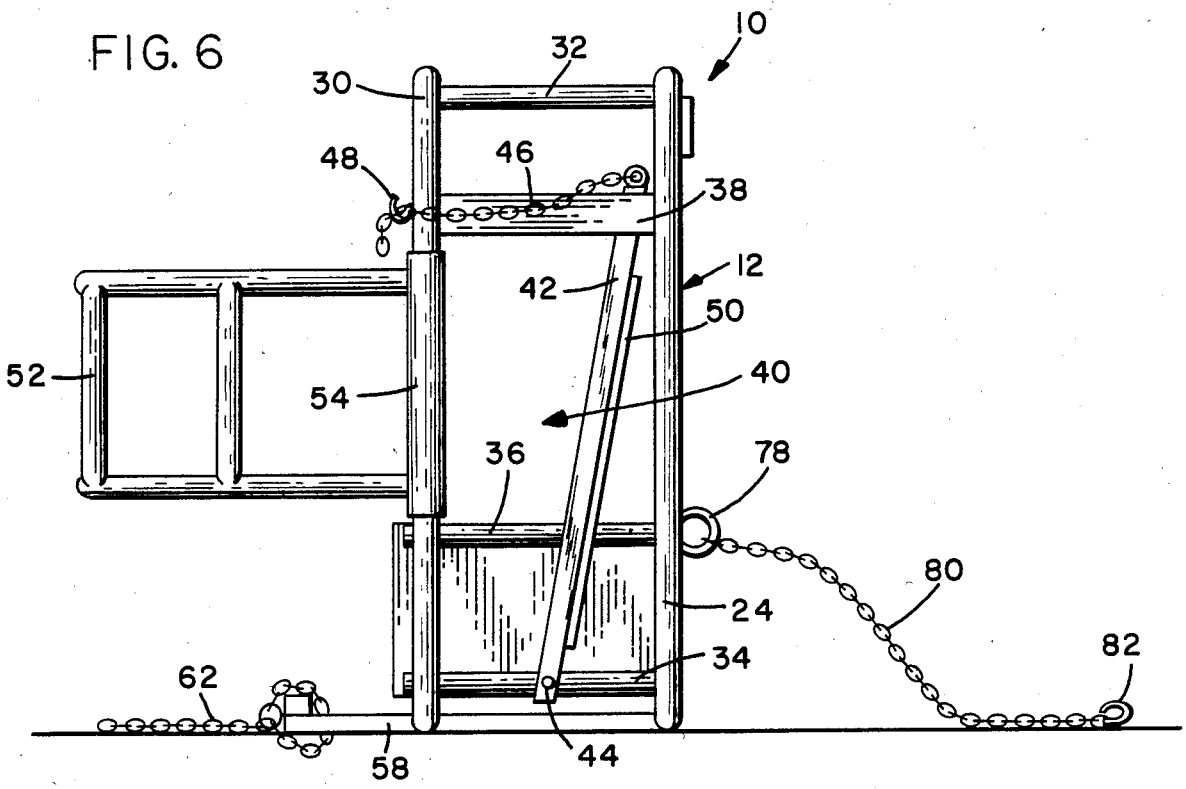
FIG. 6 is a right hand elevational view of the cradle.

Referring particularly to FIGS. 1 and 2, the cradle 10 is adapted to fit within the bucket 11 of a conventional farm tractor, and is connected to the bucket 11 by means of a pair of chains 80, see also FIGS. 5 and 6. The chains 80 are respectively attached to a pair of rings 78 which are fixed to a cross bar 84 of the back frame portion 19. The opposite end of each chain 80 is provided with a hook 82. The cradle 10 is secured to the bucket 11 by extending the chains 80 over the top of the bucket and attaching the chain to the top front post 28.

The operation and advantages of the present invention will now be readily understood in view of the above description. The cradle 10 is secured to the bucket 11 of the tractor 15 prior to receiving the farm animal or after the farm animal has been secured within the cradle. The farm animal to be treated is led or coaxed into the cradle through the opening 16 with the gate 56 in the open position shown in full lines in FIG. 4. Gate 52 is then swung toward the closed or dotted line position in FIG. 4 to force the animal into proper alignment within the cradle. The cradle 52 is longer than that which is absolutely necessary to extend across the front and left sides of the cradle as shown in FIG. 4. The length of the cradle 52 provides sufficient leverage to force the animal against the back wall of the cradle and toward the right end of the cradle so that the animal's head extends through the restricted opening 40 as shown in FIG. 1. Curved portion 56 of the gate actually provides a camming motion against the side of the animal, forcing it into its proper alignment within the cradle. The left hand end of the gate 52 is secured to the left side post 25 by means of a chain or other appropriate connector means to allow the gate to be positioned varying distances from the post 25, depending on the size of the animal which is placed in the cradle 10. The animal's head is then secured by swinging the bar 42 against the animal's neck so that it cannot withdraw its head through the opening 40. The bar is thereafter locked in this position by attaching the chain 46 to the hook 48.

When the animal is secured within the cradle 10, the chains 62 are brought up to the top front post 28 to the outside of the gate 52. The end of each chain 62 is looped around the top post 28 and the hook 64 is then snugged into the ascending portion of the chain 62. It is also contemplated that adjustable automobile seat belts could be used in place of the chains 62 for securing the front of the floor 58 to the top post 28. After the front portion of the floor 58 has been secured to the top post 28, cradle 10 can be lifted vertically by raising the bucket 11. The floor 58 supports the full weight of the animal standing upright on the floor when the cradle is in the upright position as shown in FIG. 1. The cradle 10 is thereafter rotated 90° about a horizontal axis rotating the bucket 11 relative to the tractor so that the back wall 14 assumes a lower horizontal position as shown in FIG. 2. The animal is supported by the wide belt 66 during the transition from the upright position shown in FIG. 1, to the reclining position as shown in FIG. 2. The weight of the animal is gradually shifted from the floor 58 to the cushioned pad 20 which forms part of the back wall 14. When the animal is in the reclining position as shown in FIG. 2, the animals head is supported on the flat plate 50. As soon as the weight of the animal is transferred to the back wall, the front end of the floor 58 is disconnected from the top post 28 by unhitching the chains 62 and allowing the floor to pivot about the bottom post 23, as shown in FIG. 2. The cradle 10 can be raised to any desired height by raising the bucket 11 including a height at which the floor 58 is freely suspended from the post 23 so that the free end of the floor 58 is positioned above the ground. Since the floor 58 is suspended at the back of the cradle, it does not interfer with the particular operation to be performed on the animal. It is also possible to remove the fluxible strap 66 after the animal has assumed the position shown in FIG. 2, for example, for the purpose of performing a caesarean section. Strap 66 is thereafter replaced prior to pivoting the cradle so that the animal is repositioned in the upright or standing position.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Animal cradle comprising:

(a) a housing which is adapted to be fastened to the bucket of a tractor, said housing having a vertical back wall, and a vertical support at one end of the housing which is fixed to one end of the back wall, (b) a vertical gate, one end of which is pivotally connected to said vertical support for movement about a vertical axis between a closed position and an open position, said gate extending from said support toward the opposite end of said housing and terminating in a free end at the opposite end of the gate, said free end being spaced from said back wall when said gate is in the open position so that an entrance opening is formed between said free end and the opposite end of said back wall, said entrance opening being sufficiently large to allow an animal to walk through said opening into the cradle, said gate, when in the closed position, forming a front barrier which is spaced from said back wall and an end barrier at the opposite end of said housing, (c) fastening means operatively connected to the housing for fastening the housing to the bucket of a tractor so that when the bucket is lifted and rotated by the tractor about a horizontal axis, the cradle is raised and rotated, respectively, with the bucket, and (d) support means operatively connected to the housing for supporting the animal within the housing so that when the cradle is rotated 90° about a horizontal axis so that the back wall assumes a horizontal position beneath the animal, the weight of the animal is transferred from the support means to said back wall.

2. Animal cradle as recited in claim 1, comprising:

(a) a planar supporting floor having a front end and a back end, (b) means for pivotally attaching the back end of the floor to a lower portion of the back wall, and (c) detachable support means operatively connected to the front end of the floor and the housing for supporting the weight of an animal which is positioned within the housing when the cradle is lifted from the ground.

3. Animal cradle as recited in claim 1, wherein the gate is an integral member which is shaped to extend across the front of the cradle from said vertical support and to curve toward the opposite end of said back wall when the gate is in said closed position.

4. Animal cradle as recited in claim 3, wherein the side of the gate which faces the back wall is concave along an intermediate portion of the gate between the ends of the gate.

5. Animal cradle as recited in claim 1, wherein said back wall is provided with cushioning means to provide comfort for the animal when the cradle is rotated so that the back wall assumes a horizontal position.

6. Animal cradle is recited in claim 5, wherein said back wall comprises:

(a) a heavy duty wire screen which forms a rear support base, and (b) a soft pad in front of the wire screen.

7. Animal cradle as recited in claim 1, wherein said vertical support comprises a barrier at said one end of the frame, said barrier having a restricted opening which is large enough to receive the animal's head and, wherein restraining means are provided at said restricted opening for restraining the animal's head.

8. Animal cradle as recited in claim 7, wherein said head restraining means comprise:

(a) an elongated bar which traverses said restricted opening and is pivotally mounted on the housing for movement from an open position which allows the animal to extend its head through the restricted opening to a closed position in which the bar is effective to prevent the animal from pulling its head back through the restricted opening, and (b) means for securing the bar in the closed position.

9. Animal cradle as recited in claim 8, wherein a flat plate is fixed to said elongated bar to provide a head rest for the animal when the animal's head extends through the restricted opening and when the cradle is rotated 90° so that the back wall is horizontal.

10. Animal cradle as recited in claim 1, wherein said frame includes a horizontal support bar which is located above said gate and wherein said animal supporting means comprises:

(a) a broad flexible strap attached at one end to an upper rearward portion of the housing so that it is suspended along said back wall and can be looped under the belly of an animal which is positioned in the cradle, and (b) means for attaching the opposite end of the strap to said horizontal support bar so that the animal is supported during said rotation of the cradle.

11. Animal cradle as recited in claim 10, wherein said attaching means for the opposite end of the strap is an automobile type adjustable seat belt.

* * * * *